US009051167B2

(12) United States Patent
Burge et al.

(10) Patent No.: US 9,051,167 B2
(45) Date of Patent: Jun. 9, 2015

(54) BEVERAGE DISPENSING APPARATUS

(75) Inventors: Paul Andrew Burge, South Australia (AU); Allan K. Wallace, Tranmere (AU); Scott Harris, South Australia (AU)

(73) Assignee: COOPERS BREWERY LIMITED, South Australia (AU)

( * ) Notice: Subject to any disclaimer, the term of this patent is extended or adjusted under 35 U.S.C. 154(b) by 6 days.

(21) Appl. No.: 13/383,868

(22) PCT Filed: Jul. 16, 2010

(86) PCT No.: PCT/AU2010/000911
§ 371 (c)(1),
(2), (4) Date: Apr. 12, 2012

(87) PCT Pub. No.: WO2011/006212
PCT Pub. Date: Jan. 20, 2011

(65) Prior Publication Data

US 2012/0187153 A1 Jul. 26, 2012

(30) Foreign Application Priority Data

Jul. 16, 2009 (AU) ..... 2009903325

(51) Int. Cl.
*B65D 83/00* (2006.01)
*B67D 1/04* (2006.01)
*B67D 1/08* (2006.01)

(52) U.S. Cl.
CPC ..... *B67D 1/0462* (2013.01); *B67D 1/0831* (2013.01); *B67D 2001/0828* (2013.01)

(58) Field of Classification Search
CPC ..... B67D 1/0462; B67D 1/0831; B67D 2001/0828
USPC ..... 222/386.5, 146.6, 389, 400.7, 56, 105, 222/1, 564, 402.18, 192; 141/2
See application file for complete search history.

(56) References Cited

U.S. PATENT DOCUMENTS 5,199,609 A * 4/1993 Ash, Jr. ..... 222/94
5,957,328 A * 9/1999 Osgar ..... 222/1

(Continued)

FOREIGN PATENT DOCUMENTS

EP 0389191 9/1990
GB 1032825 6/1966

(Continued)

*Primary Examiner* — Frederick C Nicolas
*Assistant Examiner* — Bob Zadeh
(74) *Attorney, Agent, or Firm* — Greenblum & Bernstein, P.L.C.

(57) ABSTRACT

The present invention relates to a refillable keg assembly for use in dispensing beverages, in particular beer. The keg assembly comprises an outer shell, and a collapsible container for holding the beverage, positionable within the outer shell. A sealed cavity is defined between the outer shell and the collapsible container. A beverage outlet from the collapsible container enables beer to be dispensed from the keg assembly, and a gas valve allows gas to enter the cavity. The pressure in the container is maintained above atmospheric pressure, and when dispensing the beverage, pressure in the cavity collapses the collapsible container and forces the beverage out through the beverage outlet. A gas compressor is connected to the gas valve, and is activated by a pressure switch to maintain the pressure within the cavity. To refill the keg assembly, the collapsible container can be replaced, and a new collapsible container filled while within the outer shell.

11 Claims, 4 Drawing Sheets

(56) References Cited

U.S. PATENT DOCUMENTS

| | | | | |
|---|---|---|---|---|
| 6,182,863 | B1 * | 2/2001 | Van Der Meer et al. | 222/105 |
| 6,325,255 | B1 * | 12/2001 | Lane et al. | 222/396 |
| 7,810,679 | B2 * | 10/2010 | Wauters et al. | 222/399 |
| 2002/0050496 | A1 * | 5/2002 | Van Der Meer et al. | 222/105 |
| 2004/0099687 | A1 * | 5/2004 | Magermans et al. | 222/105 |
| 2004/0226967 | A1 * | 11/2004 | Van Der Klaauw et al. | 222/146.6 |
| 2006/0138177 | A1 * | 6/2006 | Wauters et al. | 222/386.5 |
| 2011/0210148 | A1 * | 9/2011 | Nelson et al. | 222/386.5 |

FOREIGN PATENT DOCUMENTS

| | | | | |
|---|---|---|---|---|
| GB | EP0389191 | * | 3/1990 | B67D 1/04 |
| WO | 95/20540 | | 8/1995 | |
| WO | 2008/075388 | | 6/2008 | |

* cited by examiner

BEVERAGE DISPENSING APPARATUS

PRIORITY CLAIM

This application claims priority from Australian Patent Application No 2009903325, the entire contents of which are hereby incorporated by reference.

FIELD OF THE INVENTION

The present invention relates to container and apparatus for dispensing a beverage. The present invention will be described with particular reference to dispensing beer, although the invention may have broader application.

BACKGROUND OF THE INVENTION

Carbonated beverages, such as beer, are commonly stored in large volume containers and then dispensed to glasses or cups for consumption. Beer is often stored under pressure in a large volume metal keg (e.g. 50 liters). Kegs are artificially pressurised after fermentation using carbon dioxide, or sometimes a mixture of carbon dioxide and nitrogen gas. A typical keg has a single opening in the centre of its top, to which a flow pipe is attached. Pressure in the keg then drives the beer to the dispensing tap.

Smaller volume kegs (e.g. 5 liters) are sometimes also used, and are often termed "mini-kegs". Mini-kegs may pour from the bottom using gravity, or they may comprise a low cost pressurised tap allowing the beer to be dispensed. These mini-kegs tend to be single use devices, which are used by the consumer and not refilled—indeed, they are generally designed not be refilled and reused. However, these mini-kegs also often have problems in that the pressure provided by the tap or by gravity is often insufficient to provide a satisfying pour. Furthermore, reuse of a mini-keg would often exacerbate the problem of the difficulty in maintaining pressure within the mini-keg—it may be difficult for a home user to satisfactorily refill the keg under adequate pressure.

It is an object of the present invention to reduce or eliminate some or all of the disadvantages of conventional kegs and mini-kegs, or at least to provide an alternative to these conventional containers.

SUMMARY OF THE INVENTION

Accordingly, in a first aspect of the present invention, there is provided a refillable keg assembly for a beverage, comprising:

- an outer shell;
- a collapsible container for holding the beverage, positionable within the outer shell;
- a sealed cavity defined between the outer shell and the collapsible container;
- a beverage outlet from the collapsible container; and
- a gas valve for allowing gas to enter the cavity,
- whereby, when dispensing the beverage, pressure in the cavity collapses the collapsible container and forces the beverage out through the beverage outlet.

For dispensing the beverage from the keg assembly, the keg assembly can be connected to a dispensing device, which provides a tap having a tap handle and a tap faucet, and a gas compressor. A beverage conduit connects the beverage outlet to the tap, and a gas conduit connects the gas compressor to the gas valve. The gas compressor maintains the pressure in the sealed cavity, to a pressure above the external atmospheric pressure. Upon operation of the tap handle, the beverage is forced out of the collapsible container, flows through the beverage outlet and is dispensed via the tap faucet. This reduces the volume of the bag, reducing the pressure in the cavity, which in turn triggers a pressure activating switch for the compressor. Gas from the compressor is accordingly forced through the gas valve, into the sealed cavity, which maintains the pressure within the cavity and (at least whilst the tap is open) continues to collapse the collapsible container. In this way, the beverage is squeezed out of the collapsible container, through the beverage outlet, to the tap faucet.

The beverage within the collapsible container is kept at a relatively constant pressure—as the beverage is dispensed, the container collapses and its volume accordingly decreases. This helps maintain carbonation within carbonated beverages such as beer, and also helps ensure that the dispensing pressure allows for a satisfying pour.

Preferably, the collapsible container is disposable and replaceable. Therefore, once it has been emptied, the empty container can be discarded and a new container can simply be attached to gas and beverage valves and placed the within the outer shell. The collapsible container may therefore be adapted for detachable sealing connection to the outer shell. For example, the container may comprise a connecting component having an aperture which sealingly connects to a nozzle on or attached to the outer shell. The nozzle may be provided by a cap on the outer shell.

A flow constrictor, such as a helical channel, may be used to restrict the flow of the beverage through the beverage outlet. However, there may also be a relief valve provided to allow gas to escape from the collapsible container—this relief valve should allow the gas to escape independently of the flow constrictor, allowing the ready release of pressure from within the collapsible container, if required.

In a second aspect of the present invention, there is provided a dispensing device for connection to the keg assembly of the first aspect of the present invention. The dispensing device may comprise a tap having a tap handle and a tap faucet, the tap connected to the beverage outlet of the keg assembly, and a gas compressor in fluid connection with the gas valve of the keg assembly. A pressure activating switch may be provided which triggers the compressor upon a decrease of pressure within the cavity, such that as the beverage is dispensed, the compressor forces gas through the gas valve of the keg assembly. It accordingly helps force the beverage through the beverage outlet of the keg assembly to the tap faucet, and maintain the beverage pressure within the collapsible container. The dispensing device may also chill the beverage.

In a third aspect of the present invention, there is provided a keg for connection to a replaceable, collapsible container for holding a beverage, the collapsible container located in use within the keg and defining a sealed cavity between an outer wall of the bag and an inner wall of the keg, the keg comprising:

- a beverage outlet for allowing the beverage to flow from the collapsible container; and
- a gas valve for allowing gas to enter the cavity,
- whereby, when dispensing the beverage, pressure in the cavity collapses the collapsible container and forces the beverage out through the beverage outlet.

In a fourth aspect of the present invention, there is provided a method of refilling a beer keg, comprising:

- removing an emptied collapsible container from within the beer keg;
- inserting a new collapsible container into the beer keg; and
- filling the new collapsible container.

A detailed description of one or more preferred embodiments of the invention is provided below along with accompanying figures that illustrate by way of example the principles of the invention. While the invention is described in connection with such embodiments, it should be understood that the invention is not limited to any embodiment.

For the purpose of example, numerous specific details are set forth in the following description in order to provide a thorough understanding of the present invention. However, the present invention may be practiced without some or all of these specific details. For the purpose of clarity, technical material that is known in the technical fields related to the invention has not been described in detail so that the present invention is not unnecessarily obscured.

BRIEF DESCRIPTION OF THE DRAWINGS

An illustrative embodiment of the present invention will be discussed with reference to the accompanying drawings wherein.

DETAILED DESCRIPTION

Referring to the figures, there is shown a keg assembly 10 according to an embodiment of the present invention. This keg assembly 10 is intended to be able to contain approximately 5 liters of beverage, although obviously the volume may vary within the scope of the present invention.

Figure 1:
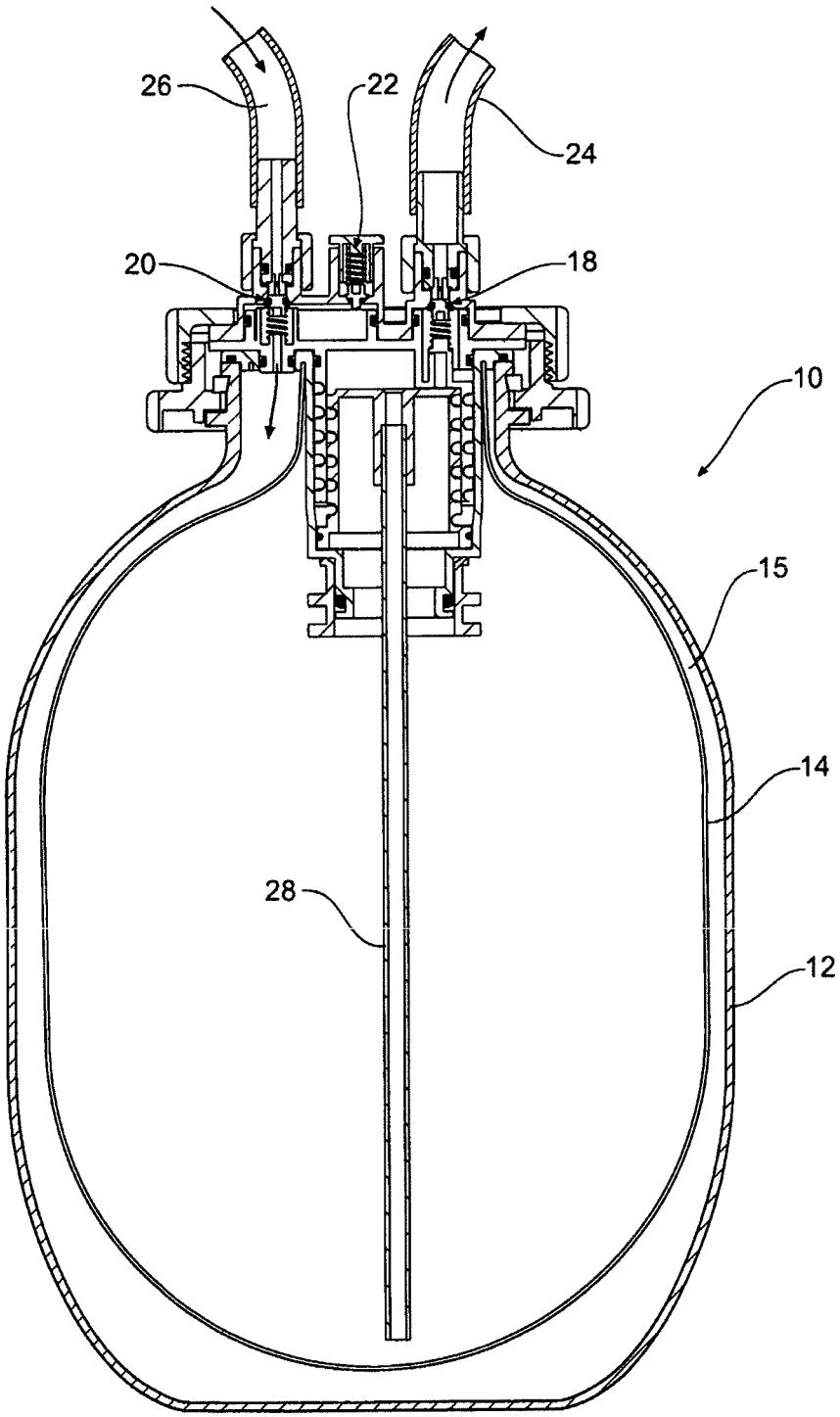
FIG. 1 is a schematic cross-section of a keg according to an embodiment of the present invention.

FIG. 1 provides a general view of a keg assembly 10 according to an embodiment of the present invention. The keg assembly 10 comprises an outer shell 12, and a bag 14 within the outer shell 12 which provides a collapsible container for beer. A sealed cavity 15 is defined between the outer shell 12 and the bag 14. The keg assembly 10 further comprises a cap assembly 30 having a beverage valve 18, a gas valve 20 and a relief valve 22. The outer shell 12 may be formed of common polyethylene teraphthalate (PET), and the bag 14 may be a simple plastic bag (e.g. commercial drinking water cask bladder).

The beverage valve 18 allows the beverage to exit the bag 14 to a beverage tube or conduit 24, which is connected to a tap for dispensing the beverage. The beverage valve 18 is depressed upon connection of the beverage outlet 24, which opens the valve 18 and allows the beverage to flow to the tap. Upon removal of the beverage tube 24, the beverage valve 18 reseals (i.e. the bag 14 is connected to the tube 24 via a self-sealing coupling). In this embodiment, the beverage valve 18 allows but does not control the beverage flow—it functions mainly to retain internal pressure whilst the keg assembly 10 is in storage, and to automatically connect or reseal the keg 10 when the keg 10 is transferred to or from the dispensing system.

Furthermore, in this embodiment, there is a dip tube 28 within the bag 14, which helps ensure that all of the beverage within the bag 14 can be dispensed. As the beverage is dispensed and the bag 14 collapses, the dip tube forms a non-blocking channel from the bottom of the bag 14. The dip tube 28 helps prevent the neck of the bag 14 from pinching off, which would otherwise prevent the beverage reaching the beverage outlet as the bag 14 collapses.

The gas valve 20 is connected to a gas tube 26, which is in turn connected to a gas compressor. During operation, the compressor maintains the pressure within the sealed cavity 15 above the external atmospheric pressure. The compressor is triggered by a pressure activating switch—as the pressure within the cavity 15 is decreased (e.g. by a decrease in volume of the bag 14 as the beverage is dispensed), the compressor forces gas through the gas tube 26 and gas valve 20, into the cavity 15. Whilst the tap is open, this effectively squeezes the bag 14, which collapses, and beer is accordingly forced out through the beverage valve 18, to the tap via the beverage tube 24.

The relief valve 22 is provided in order to allow pressure to be relieved to atmosphere in the event of excessive pressure build-up within the bag 15. This may occur occasionally with some carbonated beverages, and it can be a particular problem with beer brewed by home brewers, who may over-gas their beer.

Figure 2:
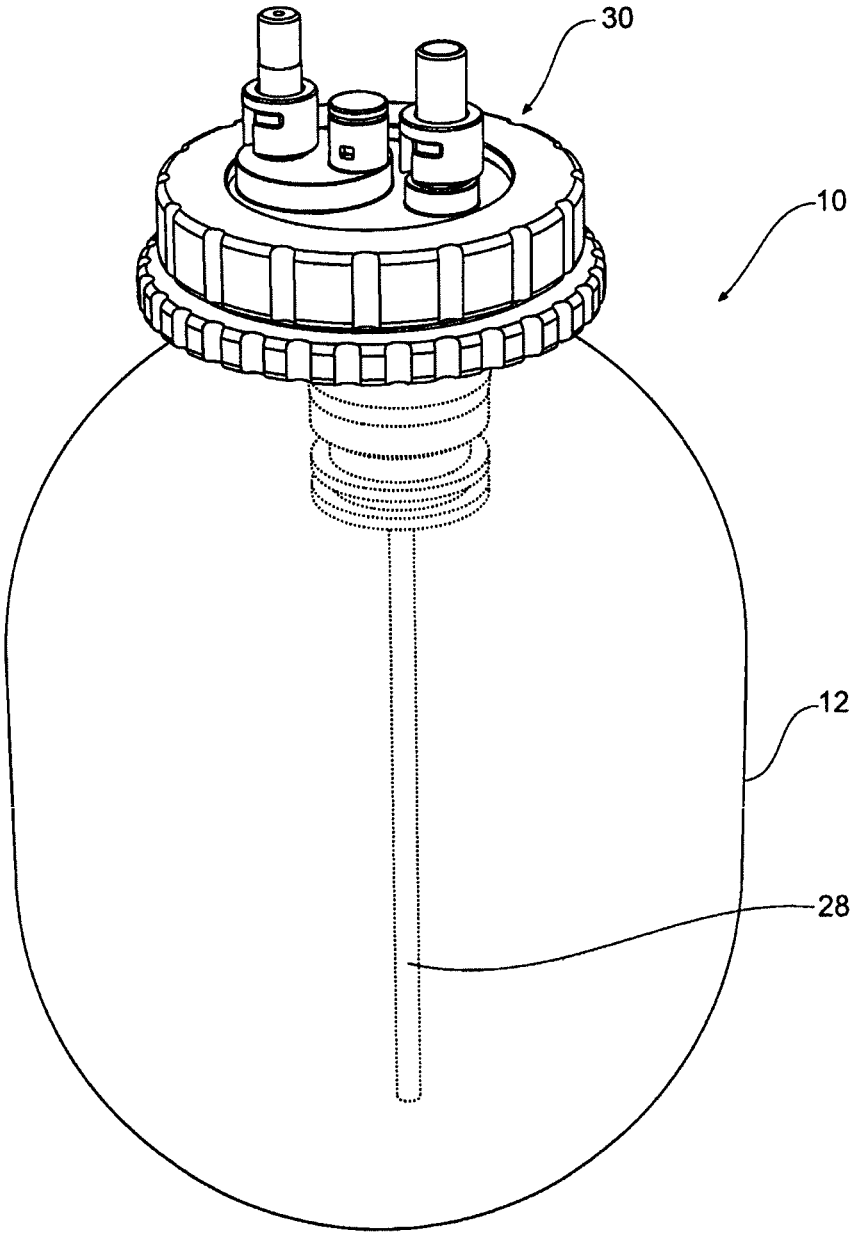
FIG. 2 is a perspective view of a keg according to an embodiment of the present invention.

FIGS. 2 to 7 show in more detail a particular embodiment of a keg assembly 10 according to the present invention. FIG. 2 is a general overview image of the keg assembly 10, with a cap assembly 30 and a dip tube 28 shown through a transparent view of the outer shell 12.

Figure 3:
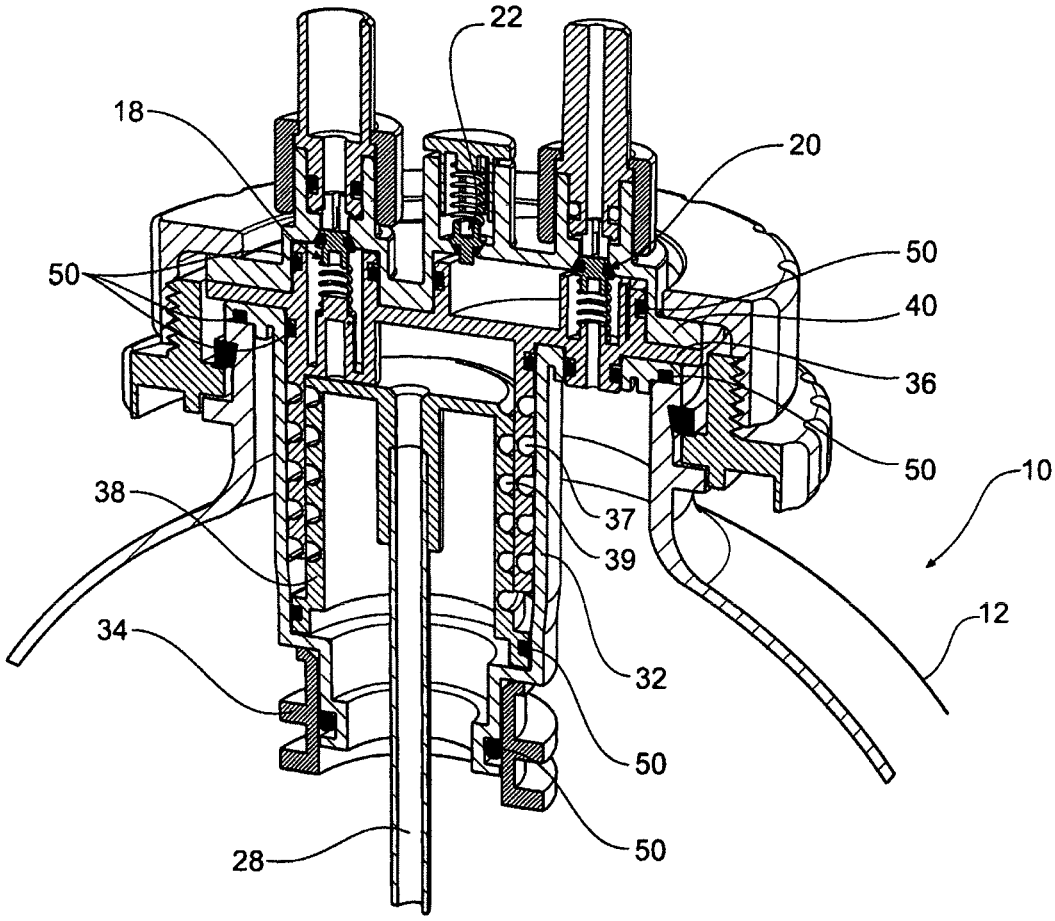
FIG. 3 is a cross-section of the keg of FIG. 2.

FIG. 3 shows the components of the cap assembly 30 in more detail. The cap assembly 30 in this embodiment comprises five components. Although these components will be described below, the shape and function of the components is probably best seen from the figures, and in particular FIG. 3.

Figure 4:
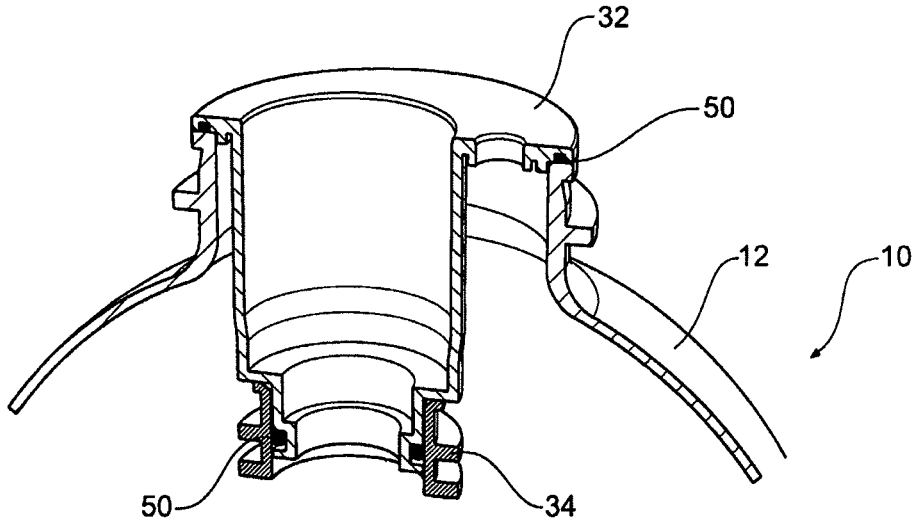
FIG. 4 is a cross-section of the keg of FIG. 2, with only the first and second keg cap components.
Figure 5:
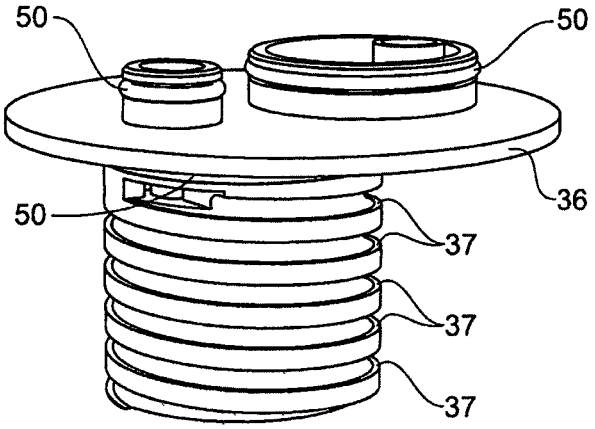
FIG. 5 is a perspective view of a third keg cap component for the keg of FIG. 2.
Figure 6:
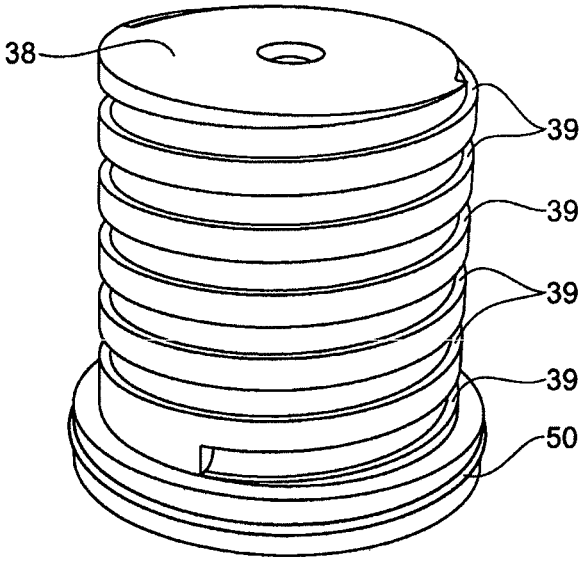
FIG. 6 is a perspective view of a fourth keg cap component for the keg of FIG. 2.
Figure 7:
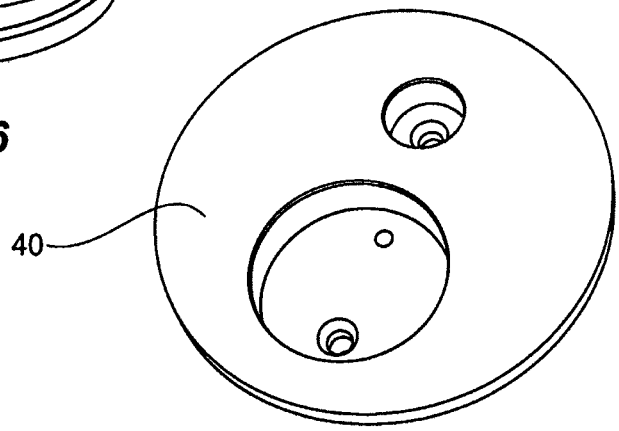
FIG. 7 is an underside perspective view of a fifth keg cap component for the keg of FIG. 2.

The first component 32 and second component 34 are shown together in FIG. 4. FIGS. 5, 6 and 7 respectively depict the third component 36, fourth component 38, and fifth component 40 of the cap assembly 30. O-rings 50 are used to ensure sealing connection between each of the cap components. A clamping arrangement (not shown) may be used to secure the cap assembly 30 together, and to secure it to the outer shell 12 of the keg assembly 10.

The first component 32 is fitted into an opening at the top of the outer shell 12. It has two apertures—a large aperture for providing a conduit into the bag 14, and a smaller aperture for providing a conduit into the cavity 15. The second component 34 is located at the bottom of the large aperture of the first component 32, and provides a nozzle for connection to the bag 14. These components are shown fitted together in FIG. 4.

In some embodiments, the second cap component 34 may be non-removably connected to the bag 14—it may simply provide a connecting component to connect the bag 14 to the cap assembly 30. It provides a relatively convenient method of allowing the bag 14 to be connected to the cap assembly 30. A user can simply push the second cap component onto the first cap component. Due to the moulded shape of the components 32, 34 which are designed to fit tightly together, and the presence of the O-rings 50, the user can be confident that the connection between the bag 14 and the cap assembly will be sealed.

A third cap component 36 is also provided, shown separately in FIG. 5. This component 36 locates within and on top of the first cap component 32. Three apertures are provided within this third component 36. There is a small aperture which connects to the small aperture of the first component 32, and allows the gas valve 20 to be fitted within it. This small aperture is located within but distinct from a second aperture, which is connected to the large aperture of the first component 32. This second aperture provides a conduit from the bag 14 to the relief valve 22. A third aperture is also connected to the large aperture of the first component 32, and provides an outlet for the beverage from the bag 14. A beverage valve 18 is located within this aperture. A helical channel 37 runs around the outside of the third component, and this defines the passage of the beverage to the beverage outlet and beverage valve 18.

FIG. 6 depicts the fourth cap component 38, which functions as a dip tube holder, and fits within the third cap component 36. It also comprises a helical channel 39, which runs around the outside of the fourth component 38. The dip tube holder 38 includes a small central aperture for beverage to exit from the dip tube 28, and a side aperture providing a conduit directly from the bag 14, independent of the dip tube 28.

The operation of the third and fourth components can best be seen from FIG. 3—the beverage is drawn through the dip tube 28 to the top of the dip tube holder 38. It then passes down the helical channel 39 of the dip tube holder 38, and back up the helical channel 37 of the third cap component 36 to the beverage valve 18. The helical channels 37, 39 restrict the flow rate during pouring, and they can be adjusted in different embodiments to suit the desired pour rate. Different cap components (i.e. different fittings) having different numbers of coils in their helical channel may be provided, for use with different beverages.

Gas pressure build-up within the bag 14 can be released directly through the relief valve 22 without passing through the dip tube 28.

FIG. 7 depicts the fifth component 40 of the cap assembly 30, which is placed on top of the third component 36. It provides flanges for connection of a beverage tube 24 and a gas tube 26, allowing exit of the beverage through the beverage valve 18 and entry of gas through the gas valve, respectively. It also comprises the relief valve 22, which allows the release of gas to relieve pressure within the bag 14. The relief valve 22 is provided to protect against rupture of the bag 14 caused by the evolution of fermenting gases attempting to overinflate the bag 14 within the outer shell 12. It is a non-return valve which prevents the flow of compressed air into the bag 14, particularly when the beverage is being dispensed.

Each of the valves 18, 20, 22 as shown in the figures, comprises silicon rubber plugs, which are retained and seated using helical springs.

During operation, the keg assembly 10 can be connected to a dispensing device, for chilling and dispensing the beverage. The dispensing device may have an internal cavity for receiving the keg assembly 10—the rigidity of the outer shell 12 helps ensure that the keg assembly has a known shape, which allows it to be readily inserted into the dispensing device.

The dispensing device also provides a tap having a tap handle and a tap faucet, and a gas compressor. The beverage tube 24 connects the beverage valve 18 to the tap faucet, and the gas tube 26 connects the gas compressor to the gas valve 20.

When the beverage tube 24 is attached, this depresses the beverage valve 18, allowing beer to flow through the beverage valve. The gas compressor maintains the pressure in the sealed cavity, to a pressure above the external atmospheric pressure. Upon operation of the tap handle, the beverage flows from the bag and is dispensed through the tap faucet. This reduces the volume of the bag 14, which accordingly decreases the pressure in the cavity. A pressure activating switch then triggers the compressor, and gas (typically air) from the compressor is forced through the gas tube 26 to the gas valve 20, into the cavity 15. This maintains the pressure within the cavity 15 and (at least whilst the tap is open) continues to collapse the bag 14. In this way, the beverage is squeezed out of the bag 14, through the beverage valve 18, to the tap faucet.

To refill the keg assembly 10 when empty, the cap assembly 30 can be removed from the outer shell 12. The beverage tube 24 and gas tube 26 may be disconnected from either or both of the cap assembly 30 and the dispenser. Then, the bag 14 can simply be removed and discarded.

Of course, in embodiments where the bag 14 is non-removably connected to the second cap component 34, this component 34 may also be discarded. A new bag 14 and connecting component 34 can then be attached to the first cap component 32.

The next step in the refilling process is to insert the first 32 and second 34 cap components can into the outer shell 12, as shown in FIG. 4. The other components are not inserted (they remain removed from the cap assembly 30), which means that the large aperture in the first component 32 provides a beverage inlet of relatively large diameter for quick and easy filling. The new bag 14 can then be filled whilst located within the outer shell 12. An auto cut-off function may be provided when filling, so a home-brewer can start the filling process, walk away, and the flow stops once the bag is full with 5 liters of beer.

Once the new bag 14 is full, the third 36, fourth 38 and fifth 40 cap components can be sealingly connected on top of the first 32 and second 34 components, using any suitable connection or clamping arrangement. If required, the dip tube 28, beverage tube 24 and gas tube 26 can then be re-connected, although disconnection of these components may not be required to refill the keg assembly 10. However, it should be noted that generally the bag will be filled with a flat beverage (e.g. a beer brew being fermented by a home brewer), which must go through a secondary fermentation. As such, it will not usually be filled and attached to the dispenser for immediate dispensing—the keg assembly 10 will usually be placed in storage for some time before the beverage is dispensed.

As previously mentioned, the outer shell 12 provides a rigid exterior to the keg assembly 10, having a known shape. This assists in connecting the keg assembly 10 to and within the dispensing device, and may also allow for easier stacking of multiple keg assemblies 10.

Although an embodiment of the present invention has been described in the foregoing detailed description, it will be understood that the invention is not limited to the embodiment disclosed, but is capable of numerous rearrangements, modifications and substitutions without departing from the scope of the invention. Modifications and variations such as would be apparent to a skilled addressee are deemed within the scope of the present invention.

For example, in some embodiments the beverage could be dispensed from the bottom of the keg—in this case, the beverage valve may be located at the bottom of the bag, along with the other connections for connecting the bag within the outer shell and dispensing the beverage. This may reduce the need for a dip tube. However, it should be noted that in such an embodiment, there may be additional issues caused by sediment in the beverage. Furthermore, a pressure relief valve will still preferably be located at the top of the bag, and accordingly the bag may be more complicated with separate outlets at the bottom and top of the bag for the beverage and for excess gas, respectively.

It should also be noted that the keg assembly of the present invention could also be useful for artificially carbonating the beverage. The dispensing unit is already adapted to chill the beverage, so it is ready to take on carbon dioxide. Accordingly, gas may be forced through the beverage valve into the bag. The dip tube is well suited to take the carbon dioxide initially to the bottom of the bag, which facilitates its circulation within the beverage.

Throughout this specification and the claims that follow unless the context requires otherwise, the words 'comprise' and 'include' and variations such as 'comprising' and 'including' will be understood to imply the inclusion of a stated integer or group of integers but not the exclusion of any other integer or group of integers.

The reference to any prior art in this specification is not, and should not be taken as, an acknowledgment or any form of suggestion that such prior art forms part of the common general knowledge.

The invention claimed is:

1. A refillable keg assembly for a beverage, comprising:

an outer shell comprising an aperture;

a collapsible container for holding the beverage, positionable within the outer shell and insertable via the aperture;

a sealed cavity defined between the outer shell and the collapsible container;

a beverage outlet from the collapsible container;

a gas valve for allowing gas to enter the sealed cavity;

a dip tube within the collapsible container to provide a non-blocking channel from near a bottom of the collapsible container to the beverage outlet;

a helical passage from the top of the dip tube to the beverage outlet, which acts as a flow constrictor to restrict a flow rate as the beverage is dispensed from the beverage outlet; and a cap assembly that connects to the outer shell to close the aperture, the cap assembly comprising:

a plurality of cap components including one or more removable cap components such that when the cap assembly is connected to the outer shell removal of at least one of the one or more removable cap components from another of the plurality of cap components that remains connected to and supported by the outer shell defines a beverage inlet extending into the aperture of the outer shell to allow filling the collapsible container within the refillable keg, wherein the plurality of cap components comprises:

a first cap component fitted into an opening at a top of the outer shell and which forms at least part of the beverage inlet for filling the collapsible container; and a dip tube holder which fits within a removable cap component, the removable cap component located within and on top of the first cap component such that removal of the removable cap component from the first cap component defines the beverage inlet, and the dip tube is connected to a top of the dip tube holder, the helical passage comprises:

a helical passage running around an outside of the dip tube holder; and a helical passage running around an outside of the removable cap component such that in use the beverage passes down the helical passage of the dip tube holder from the top of the dip tube, and back up the helical passage of the removable cap component to the beverage outlet, the cap assembly is adapted to connect to the collapsible container such that the collapsible container locates within the outer shell, the gas valve and the beverage outlet are located within the cap assembly, when the refillable keg is in use, the cap assembly is sealingly connected to the outer shell, and when dispensing the beverage, pressure in the sealed cavity collapses the collapsible container and forces the beverage out through the beverage outlet.

2. The refillable keg assembly of claim 1, wherein gas in the sealed cavity is maintained at a pressure greater than atmospheric pressure.

3. The refillable keg assembly of claim 1, further comprising a relief valve to allow pressure to be relieved from the collapsible container and prevent the collapsible container from rupturing.

4. The refillable keg assembly of claim 1, wherein the first cap component includes a large aperture for providing a conduit into the collapsible container and a small aperture for providing a conduit into the sealed cavity, the large aperture providing the beverage inlet, the collapsible container is replaceable in order to refill the keg assembly, the plurality of cap components further comprises:

a second cap component located at a bottom of the large aperture of the first cap component, and the collapsible container is connected to the second cap component.

5. The refillable keg assembly of claim 1, wherein the beverage is beer.

6. A dispenser adapted for connection to the refillable keg assembly of claim 1, the dispenser comprising an internal cavity for receiving the refillable keg assembly.

7. The refillable keg assembly of claim 1, wherein the first cap component includes a large aperture for providing a conduit into the collapsible container and a small aperture for providing a conduit into the sealed cavity and the beverage inlet is defined by the large aperture, the removable cap component is a third removable cap component, the plurality of cap components further comprises:

a second cap component located at a bottom of the large aperture of the first cap component, wherein the collapsible container is connected to the second cap component;

a fourth removable cap component located within the third removable cap component, the fourth removable cap component including an aperture for the dip tube; and a fifth removable cap component on top of the third removable cap component, the fifth removable cap component including the gas valve for providing gas into the sealed cavity via the small aperture in the first cap component, and the beverage outlet for the beverage in the collapsible container, the helical passage connects the beverage outlet to the aperture for the dip tube, and the beverage inlet is defined by removal of the third removable cap component, the fourth removable cap component and the fifth removable cap component from the first cap component and the second cap component to allow filling of the refillable keg via the large aperture.

8. A keg for connection to a replaceable, collapsible container for holding a beverage, the collapsible container located in use within the keg and defining a sealed cavity between an outer wall of the bag and an inner wall of the keg, the keg comprising:

an outer shell comprising an aperture;

a beverage outlet for allowing the beverage to flow from the collapsible container; and a gas valve for allowing gas to enter the sealed cavity;

a dip tube within the collapsible container to provide a non-blocking channel from near a bottom of the collapsible container to the beverage outlet;

a helical passage from the top of the dip tube to the beverage outlet, which acts as a flow constrictor to restrict the flow rate as the beverage is dispensed from the beverage outlet; and a cap assembly that connects to the outer shell to close the aperture, the cap assembly comprising a plurality of cap components including one or more removable cap components such that when the cap assembly is connected to the outer shell removal of at least one of the one or more removable cap components from another of the plurality of cap components that remains connected to and supported by the outer shell defines a beverage inlet extending into the aperture of the outer shell to allow filling the collapsible container within the refillable keg, wherein the plurality of cap components comprises:

a first cap component fitted into an opening at a top of the outer shell and which forms at least part of the beverage inlet for filling the collapsible container; and a dip tube holder which fits within a removable cap component, the removable cap component located within and on top of the first cap component such that removal of the removable cap component from the first cap component defines the beverage inlet, and the dip tube is connected to a top of the dip tube holder, the helical passage comprises:

a helical passage running around an outside of the dip tube holder; and a helical passage running around an outside of the removable cap component such that in use the beverage passes down the helical passage of the dip tube holder from the top of the dip tube, and back up the helical passage of the removable cap component to the beverage outlet, the cap assembly is adapted to connect to the collapsible container such that, in use, the collapsible container locates within the outer shell, the gas valve and the beverage outlet are located within the cap assembly, when the keg is in use, the cap assembly is sealingly connected to the outer shell, and when dispensing the beverage, pressure in the sealed cavity collapses the collapsible container and forces the beverage out through the beverage outlet.

9. The keg of claim 8, wherein the beverage is beer.

10. A method of refilling a beer keg, comprising:

removing a first cap component, a second cap component and at least one further cap component, and an emptied collapsible container from within the beer keg, wherein the emptied collapsible container is connected to the second cap component;

attaching one of the second cap component, or a new replacement second cap component connected to a new replacement collapsible container onto the first cap component and into the beer keg, the first cap component including a large aperture for providing a conduit into the collapsible container and a small aperture for providing a conduit into a cavity defined between an outer shell of the beer keg and the new replacement collapsible container;

filling the new replacement collapsible container using a beverage inlet defined by the large aperture in the first cap component;

inserting the at least one further cap component on top of the first cap component; and sealingly connecting the first cap component, the one of the second cap component, or the new replacement second cap component, and the further cap component, as a cap assembly, to the beer keg.

11. The method of claim 10, wherein the at least one further cap component comprises a third cap component, a fourth cap component and a fifth cap component such that the inserting of the at least one further cap component further comprises:

inserting the third cap component within and on top of the first cap component;

inserting the fourth cap component within the third cap component, the fourth cap component including an aperture for a dip tube; and inserting the fifth cap component on top of the third cap component, the fifth cap component including a gas valve for providing gas into the cavity via the small aperture in the first cap component, and a beverage outlet for the beverage in the collapsible container wherein a helical path connects the beverage outlet to the aperture for the dip tube; and the sealingly connecting of the cap assembly to the beer keg further comprises:

applying a clamping force to the cap assembly to seal the cap assembly to the beer keg.

* * * * *